US008174202B2

(12) United States Patent
Nijhof et al.

(10) Patent No.: US 8,174,202 B2
(45) Date of Patent: May 8, 2012

(54) LAMP DRIVING CIRCUIT

(75) Inventors: Engbert Bernard Gerard Nijhof, Eindhoven (NL); Jozef Petrus Emanuel De Krijger, Eindhoven (NL); Marcel Johannes Maria Bucks, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 458 days.

(21) Appl. No.: 12/302,037

(22) PCT Filed: May 29, 2007

(86) PCT No.: PCT/IB2007/052014

§ 371 (c)(1),
(2), (4) Date: Nov. 24, 2008

(87) PCT Pub. No.: WO2007/138549

PCT Pub. Date: Dec. 6, 2007

(65) Prior Publication Data

US 2009/0267528 A1 Oct. 29, 2009

(30) Foreign Application Priority Data

May 31, 2006 (EP) ..... 06114772

(51) Int. Cl.
*H05B 41/36* (2006.01)

(52) U.S. Cl. ..... 315/226; 315/209 R; 315/224; 315/291; 315/307

(58) Field of Classification Search ..... 315/209 R, 315/224, 246, 247, 291, 307, 311, 226
See application file for complete search history.

(56) References Cited

U.S. PATENT DOCUMENTS

| | | | | |
|---|---|---|---|---|
| 6,020,691 | A * | 2/2000 | Sun et al. | 315/307 |
| 6,426,597 | B2 * | 7/2002 | Rast et al. | 315/219 |
| 6,577,078 | B2 * | 6/2003 | Shen | 315/307 |
| 7,218,066 | B2 * | 5/2007 | Van Casteren | 315/307 |
| 2005/0062432 | A1 | 3/2005 | Van Casteren | |
| 2005/2069969 | | 12/2005 | Van Casteren | |
| 2006/0071611 | A1 * | 4/2006 | Van Casteren | 315/225 |

FOREIGN PATENT DOCUMENTS

| | | | |
|---|---|---|---|
| WO | 2004023851 | A1 | 3/2004 |
| WO | 2004066688 | A1 | 8/2004 |

* cited by examiner

*Primary Examiner* — Douglas W Owens
*Assistant Examiner* — Thai Pham

(57) ABSTRACT

A lamp driving circuit (10) for operating a discharge lamp has a series arrangement of a first and a second switching device (Q1, Q2) connecting supply voltage input terminals. An inverter resonant circuit (20, 30) shunts one of the switching devices and has an inverter inductance (L1), an inverter capacitance (C1), and lamp connection terminals (O1, O2). A control circuit (40) controls the switching devices to generate a lamp current ($I_L$) commutating at a commutation frequency. During a first interval of a commutation period, the control circuit renders the first switching device alternately conducting during a first time period and non-conducting during a second time period at a high frequency being higher than the commutation frequency, and during a second interval of the commutation period, the control circuit renders the second switching device alternately conducting during a third time period and non-conducting during a fourth time period at a high frequency being higher than the commutation frequency. At the start of the first and second intervals of the commutation period, the first time period and the third time period, respectively, are extended for realizing an increased speed of commutation of the lamp current. Alternatively, at the end of the first and second intervals of the commutation period, the second time period and the fourth time period, respectively, are extended for realizing an increased speed of commutation of the lamp current.

12 Claims, 2 Drawing Sheets

LAMP DRIVING CIRCUIT

FIELD OF THE INVENTION

The present invention relates to a lamp driving circuit, and in particular to a commutating forward lamp driving circuit.

BACKGROUND OF THE INVENTION

A lamp driving circuit for a gas discharge lamp (such as a high intensity discharge (HID) lamp, but not limited thereto) serves to feed the gas discharge lamp with a required amount of current, and receives power itself from a mains voltage source, such as an AC voltage source. Conventionally, such a lamp driving circuit comprises three stages: a rectifier and upconverter for converting the AC input voltage to a higher DC output voltage, a downconverter (forward converter) for converting said DC voltage to a lower voltage but higher current, and finally a commutator switching the DC current for the lamp at a relatively low frequency. In more recent designs, the last two stages (i.e. the downconverter and the commutator) have been integrated into a single stage, referred to as forward commutating stage.

A forward commutating lamp driving circuit may be embodied in a half-bridge commutating forward (HBCF) topology or a full-bridge commutating forward (FBCF) topology. Thus, such a forward commutating stage always has at least one chain of two series-connected power switching elements, such as MOSFET switches, wherein the gas discharge lamp to be driven is coupled to the node between said two switching elements.

In gas discharge lamps, especially in lower power metal halide gas discharge lamps, a speed of commutation of the lamp current must be high. If commutation is slow, the temperature of the electrodes of the lamp could drop too much during commutation because of the low thermal time-constant of the electrodes, and an instantaneous thermionic emission in the cathode phase will be inhibited. This may lead to high lamp voltage peaks after commutation, deterioration of the electrodes, and lamp extinguishment.

US 2005/0062432 A1 discloses a device for operating a high-pressure discharge lamp, comprising control means for controlling at least one power switching element in its switched-on and switched-off states for controlling the power or current supplied to the high-pressure discharge lamp. The control means are adapted to control the power consumed by the lamp by controlling the on-time (Ton) of the switched-on state of the at least one power switching element.

US 2005/0269969 A1 discloses a driver for gas discharge lamps in which a lamp circuit current is sensed to switch the power switching elements of the driver when the lamp circuit current crosses zero. A zero-crossing sensor consists of a small transformer having its primary winding connected in series with the lamp current. The small transformer is already saturated at relatively small primary currents, and comes out of saturation near a current zero-crossing to provide a signal at a secondary winding of the transformer to control the power switching elements.

OBJECT OF THE INVENTION

It is desirable to have a forward commutating lamp driving circuit and a corresponding method for operating a gas discharge lamp, in which a lamp current commutation can be made very fast.

SUMMARY OF THE INVENTION

In an aspect, the present invention provides a lamp driving circuit according to claim 1 or 3.

In a further aspect, the present invention provides a method of operating a gas discharge lamp according to claim 6 or 8.

The lamp driving circuit, and the method of operating a gas discharge lamp, according to the present invention enable a very fast commutation of the lamp current. Such fast commutation prevents the temperature of the electrodes of the lamp, having a small thermal time constant, to drop too much which would cause an instantaneous thermionic emission of the electrodes in the cathode phase to stop.

Controlling the switching devices, such as MOSFETs, such that at the start of the first and second intervals (e.g. halves) of the commutation period, the time period when the first switching device is rendered conducting and the time period when the second switching device is rendered conducting, respectively, are extended, realizes an increased speed of commutation of the lamp current. Alternatively, the switching devices may be controlled such that at the end of the first and second intervals (e.g. halves) of the commutation period, the time period when the first switching device is rendered non-conducting and the time period when the second switching device is rendered non-conducting, respectively, are extended, for realizing an increased speed of commutation of the lamp current.

The control circuit may receive an output signal from a current sensing circuit for detecting when an inverter inductance current flowing through an inverter inductance crosses zero, in order to determine the time to render a switching device conductive. However, also other control schemes, either implemented in hardware or in software, or both, may be used in the control of the gas discharge lamp to implement the present invention.

BRIEF DESCRIPTION OF THE DRAWINGS

Hereinafter the present invention is elucidated in more detail with reference to the appended drawings illustrating non-limiting embodiments, wherein.

DETAILED DESCRIPTION OF EXAMPLES

Figure 1:
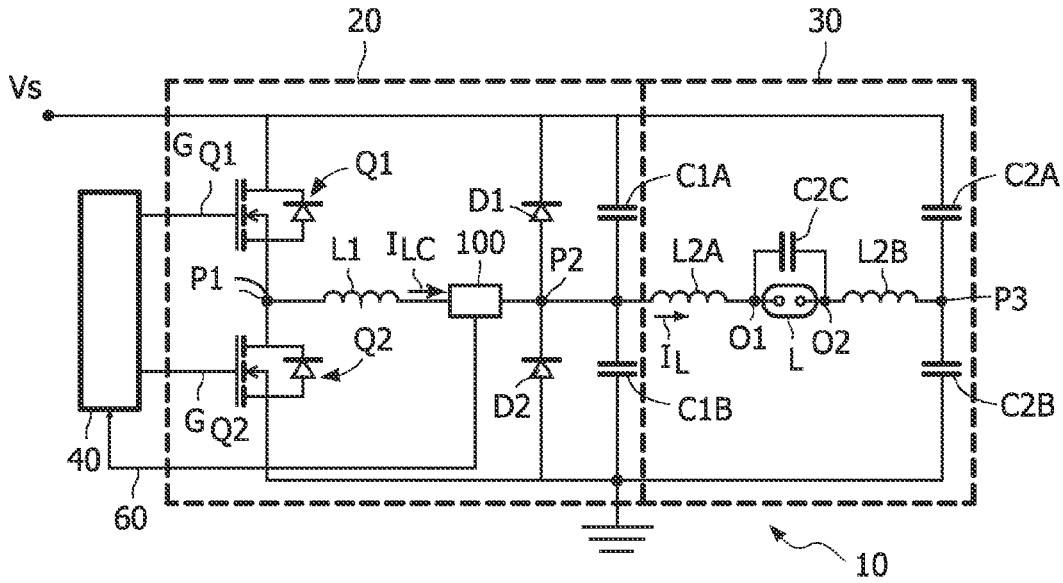
FIG. 1 shows a circuit diagram of an exemplary embodiment of a lamp driver circuit according to the present invention.

In the drawings, like reference numerals refer to like components.

FIG. 1 shows an embodiment of a lamp driving circuit 10 according to the present invention. In this embodiment, a commutation forward stage is of a half-bridge type. However, a person skilled in the art will recognize that the invention can also, mutatis mutandis, be applied to a commutating forward device of a full-bridge type. The lamp driving circuit 10 comprises an inverter circuit 20 and an output circuit 30.

The inverter circuit 20 comprises a first switching device Q1 and a second switching device Q2. Each switching device Q1, Q2 may be a MOSFET having a body diode, which is shown in the drawing. The switching devices Q1, Q2 are controlled by a control circuit 40 coupled to gates $G_{Q1}$, $G_{Q2}$ of the respective switching devices Q1, Q2. The switching devices Q1, Q2 form a commutation circuit. The inverter circuit 20 further comprises an inverter resonant circuit comprising an inverter inductance L1 and an inverter capacitance C1 formed by capacitors C1A, C1B. The inverter resonant circuit is connected to a node P1 of the commutation circuit. A clamping circuit comprising a first clamping diode D1 and a second clamping diode D2, both connected to a node P2 of the inverter resonant circuit.

The output circuit 30 comprises an output resonant circuit comprising an output inductance L2 formed by inductors L2A, L2B, and an output capacitance C2 comprising output capacitors C2A, C2B, C2C. The output inductance L2 may also be embodied as one inductor. When hereinafter reference is made to an output inductor L2, this is intended to refer to both inductors L2A and L2B. The output capacitors C2A and C2B form a voltage divider, dividing a supply voltage Vs. The output capacitor C2C is formed by a lamp capacitance and parasitic capacitances, and may further comprise an ignition capacitor. When referring to the output capacitance C2, this is intended to refer to all three output capacitors C2A, C2B and C2C. The output circuit 30 further comprises two output terminals O1, O2. A gas discharge lamp L is connected between said output terminals O1, O2.

The supply voltage Vs is provided at a suitable terminal of the lamp driving circuit 10. At another terminal the lamp driving circuit 10 is connected to ground. Thus, a supply voltage Vs is applied over input terminals of the lamp driving circuit 10.

A current sensing circuit 100 is adapted to sense a current $I_{LC}$ flowing through the inverter inductance L1, and to provide a signal indicating a zero-crossing of the current $I_{LC}$ to the control circuit 40, as indicated by a line 60.

Figure 2:
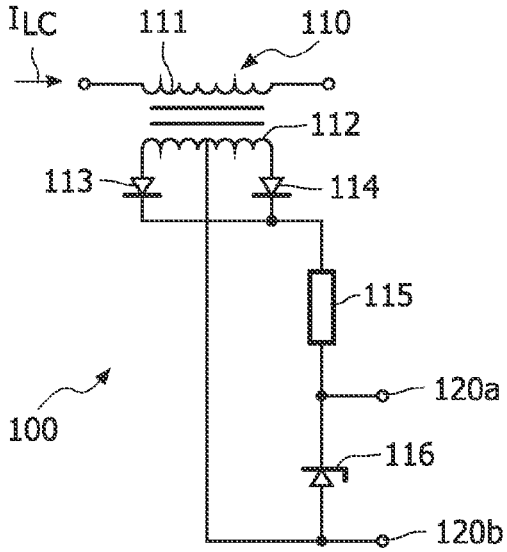
FIG. 2 shows a circuit diagram of an exemplary embodiment of a current zero-crossing sensing circuit.

FIG. 2 shows an embodiment of the current sensing circuit 100 as disclosed in US 2005/0269969 A1. The current sensing circuit 100 comprises a small transformer 110 having a primary winding 111 and a secondary winding 112. The primary winding 111 is connected in series with the inverter inductance L1, so that the current $I_{LC}$ passes through the primary winding 111. A first diode 113 has its anode connected to a first end of the secondary winding 112, and a second diode 114 has its anode connected to the other end of the secondary winding 112. The cathodes of the first and second diodes 113, 114 are connected together and to a first terminal of a resistor 115, the other terminal of the resistor 115 being connected to a first output terminal 120*a* of the current sensing circuit 100. A second output terminal 120*b* of the current sensing circuit 100 is connected to a central terminal of the secondary winding 112.

The transformer 110, preferably of the toroidal type, but not limited thereto, is very small, so that its core is saturated even at a relatively small current $I_{LC}$ through its primary winding 111. In such a saturated condition, an increase or decrease of the lamp current through the primary winding 111 will not result in any significant output signal in the secondary winding 112. However, as soon as the current through the primary winding 111 approaches zero, the transformer 110 comes out of saturation and is capable of generating a voltage peak between the two ends of its secondary winding 112. Depending on the sign of this voltage peak with reference to the central terminal and therefore with reference to the second output terminal 120*b*, the first diode 113 or the second diode 114 directs this voltage peak via the resistor 115 to the first output terminal 120*a*. Preferably, a zener diode 116 is connected between the two output terminals 120*a* and 120*b*, clamping the voltage level of the output pulse to a desired logical value and thus preventing that the voltage at the first output terminal 120*a* can rise too high.

Near a zero-crossing of the lamp current, the current sensing circuit 100 provides at its secondary winding 112 an output pulse, which substantially coincides with the actual zero-crossing of the current $I_{LC}$ in the primary winding 111. The rising edge of this voltage pulse is located in time before the actual zero-crossing. Thus, if the control circuit 40 (FIG. 1) is designed to respond to the rising edge of said output pulse, i.e. that the control circuit 40 is triggered by the rising edge of the output pulse, the actual moment of switching the switching devices Q1, Q2 can accurately coincide with the actual zero-crossing of the lamp current.

Figure 3:
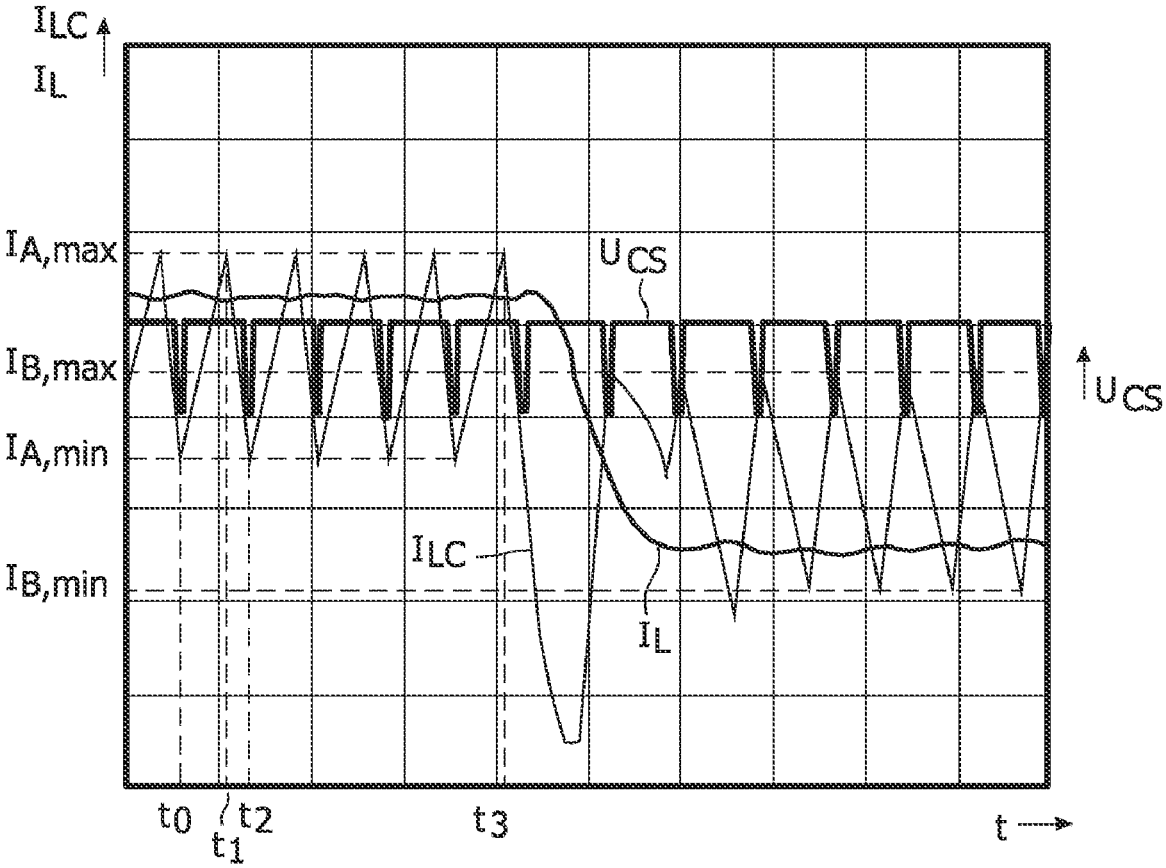
FIG. 3 shows a timing diagram of an inverter inductance current, a current zero-crossing sensing signal, and a lamp current.

Operation of the lamp driving circuit 10 according to FIG. 1 is elucidated with reference to FIG. 3. In the timing diagram of FIG. 3, the inverter inductance current $I_{LC}$ flowing through the inverter inductance L1 is shown during a steady state operation.

Referring to FIGS. 1 and 3, the inverter inductance current $I_{LC}$ represents a supply current generated by the inverter circuit 20. In a commutation interval, switching device Q1 is operated as a master switching device, whereas switching device Q2 is operated as a slave switching device. In a subsequent commutation interval, this master/slave relationship is reversed.

As shown in FIG. 3, at time $t_0$ the control circuit 40 controls the master switching device Q1 to switch conductive. The timing of this control is determined from an output pulse of the current sensing circuit 100, as will be further explained below in relation to FIG. 3. Consequently, a current starts to develop through the inverter inductance L1. The current increases to a level $I_{A,max}$ . At time $t_1$ the master switching device Q1 is switched non-conductive. The inverter inductance L1 attempts to maintain the developed current, resulting in a freewheel current flowing through the body diode of the slave switching device Q2.

In a dual MOSFET operation mode, the slave switching device Q2 is then switched conductive, resulting in the freewheel current flowing through the MOSFET and reducing the freewheel current through the body diode of slave switching device Q2. The freewheel current gradually decreases and reaches zero and is then reversed in direction. The slave switching device Q2 is switched non-conductive and the reversed freewheel current generates a resonant swing of the voltage at node P1 to the opposite rail voltage. Thus, in dual MOSFET mode, disadvantages of use of the body diode, such as a relatively large forward loss and a relatively bad turn-off loss may be circumvented.

At time $t_2$, when the current is at the level $I_{A,min}$ , the master switching device Q1 is switched conductive again by the control circuit 40. The timing of this control is determined from a further output pulse of the current sensing circuit 100, as will be further explained below with reference to FIG. 3. The cycle from $t_0$ to $t_2$ may then be repeated from time $t_{2-}$.

Thus, in a first commutation interval A being a first half of a commutation period, the inverter inductance current $I_{LC}$ alternates between a minimum level $I_{A,min}$ and a maximum level $I_{A,max}$ at a frequency equal to the switching frequency of the master switching device Q1. The switching of the master switching device Q1 is repeated until time $t_3$ , which represents the end of the first commutation interval A.

At time $t_3$ , the second switching device Q2 is made master and the first switching device Q1 is made slave. Thus, from time $t_3$ , the current is commutated and a second commutation interval B, being a second half of a commutation period, is started. During commutation interval B, the inverter inductance current $I_{LC}$ alternates between a minimum level $I_{B,min}$ and a maximum level $I_{B,max}$ . Due to the buffering of the inverter capacitance C1A, C1B and the low-pass filtering by the output inductance L2 in combination with the impedance of the arcing gas discharge lamp, the switching frequency signal in the inverter inductance current $I_{LC}$ is reduced and a substantially rectangular shaped current alternating between the levels $I_{A,max}$ and $I_{B,min}$ results as a lamp current $I_L$ supplied to the output terminals O1, O2 and the lamp L connected therebetween. The frequency of the low frequency alternating, e.g. essentially rectangular shaped, lamp current $I_L$ is equal to the frequency used for switching the first and the second switching devices Q1, Q2 to be master and slave. This frequency may be referred to as the commutation frequency.

It is to be observed here, that the low frequency lamp current may also deviate from a square wave shape in other switching device driving schemes.

In the commutation of the lamp current $I_L$, the output pulse from the current sensing circuit 100 in combination with a peak current synthesis of the inverter inductance current $I_{LC}$, derived from a voltage measured between nodes P2 and P3 (FIG. 1), may provide a control of the current $I_{LC}$ by the control circuit 40.

FIG. 3 shows a current sensing signal $U_{CS}$ from the current sensing circuit 100. The current sensing signal $U_{CS}$ shows (in this exemplary embodiment) pulses when the inverter inductance current $I_{LC}$ is around zero. These pulses are output to the control circuit 40 to control the times when the switching devices Q1, Q2 are to be active and conductive.

In the control of the lamp driving circuit, the output pulses contained in the current sensing signal $U_{CS}$ are inhibited by the control circuit 40 just before commutation: as an example, the output pulse subsequent to $t_3$ is inhibited. This causes the switching device Q2 to remain on (in a dual MOSFET operation mode, at the end of the first commutation interval) just as long as its maximum so-called off-time. The maximum off-time is a design parameter which can be chosen during commutation. Thus, the inverter inductance current $I_{LC}$ becomes strongly negative. After the maximum off-time, the logic in the control circuit 40 is set to operate in a negative lamp current mode, and the output pulses contained in the current sensing signal $U_{CS}$ are no longer inhibited by the control circuit 40. A correct filtering of the voltage measured between nodes P2 and P3 (being a representation of the inverter inductance current $I_{LC}$) is then applied to keep a lamp current ripple acceptable.

The larger inverter inductance current $I_{LC}$ at the beginning of a new commutation phase (as illustrated in FIG. 3 from the time $t_3$) makes the voltage at node P2 change faster than in the prior art, which leads to a faster commutation of the lamp current $I_L$. Lamp currents $I_L$ with a rise/fall time below 10 μs and a crest factor which is below 1.2 can easily be attained. As a result of the fast voltage change at node P2, the voltage across the series arrangement of output inductance L2 and the gas discharge lamp L rapidly reaches a high value, so that a large current $I_L$ is supplied to the lamp L even when the lamp voltage is comparatively high. These effects effectively prevent extinguishing of the gas discharge lamp, in particular a lower power metal halide gas discharge lamp, during commutation. It is noted that a fast commutation can also be realized when the output inductance L2 is embodied as a single inductor in series with the lamp L, instead of being embodied as a plurality of inductors L2A, L2B.

It is considered that the above description of the operation of the lamp driving circuit 10 provides sufficient information to a person skilled in the art for selecting components having a suitable impedance, capacitance, inductance, resistance, etc. It is noted that a suitable commutation frequency may be in the order of 100-500 Hz, preferably in the order of 400 Hz, and a suitable switching frequency for the switching devices Q1, Q2 may be in the order of 100 kHz.

Although detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the terms and phrases used herein are not intended to be limiting but rather, to provide an understandable description of the invention. The terms "a" or "an", as used herein, are defined as one or more than one. The term another, as used herein, is defined as at least a second or more. The terms including and/or having, as used herein, are defined as comprising (i.e., open language). The term coupled, as used herein, is defined as connected, although not necessarily directly, and not necessarily by means of wires.

The invention claimed is:

1. A lamp driving circuit for operating a discharge lamp, the lamp driving circuit comprising:

input terminals for connection to a supply voltage source, a series arrangement comprising a first switching device and a second switching device, and connecting the input terminals, an inverter resonant circuit shunting one of the switching devices and comprising an inverter inductance, an inverter capacitance, and lamp connection terminals, a control circuit coupled to respective control electrodes of the switching devices to generate a lamp current commutating at a commutation frequency, the control circuit being configured for:

during a first interval of a commutation period, for a plurality of alternating first and second time periods rendering the first switching device alternately conducting during each first time period and non-conducting during each second time period at a high frequency being higher than the commutation frequency, during a second interval of the commutation period, for a plurality of alternating third and fourth time periods rendering the second switching device alternately conducting during each third time period and non-conducting during each fourth time period at a high frequency being higher than the commutation frequency, and extending one of the first time periods at the start of the first interval of the commutation period to have a longer duration than the other first time periods, and extending one of the third time periods at the start of the second interval of the commutation period to have a longer duration than the other third time periods.

2. The lamp driving circuit according to claim 1, further comprising a current sensing circuit configured for:

sensing an inverter inductance current flowing through the inverter inductance, generating an output signal signaling to the control circuit when the inverter inductance current crosses zero, the control circuit being configured for:

in response to receipt of the output signal in the first interval of the commutation period and before the end of the first interval of the commutation period, rendering the first switching device conductive, in response to receipt of the output signal in the second interval of the commutation period and before the end of the second interval of the commutation period, rendering the second switching device conductive, in response to receipt of the output signal at a start of the first interval of the commutation period, not rendering the second switching device conductive, and in response to receipt of the output signal at a start of the second interval of the commutation period, not rendering the first switching device conductive.

3. A lamp driving circuit for operating a discharge lamp, the lamp driving circuit comprising:

input terminals for connection to a supply voltage source, a series arrangement comprising a first switching device and a second switching device, and connecting the input terminals, an inverter resonant circuit shunting one of the switching devices and comprising an inverter inductance, an inverter capacitance, and lamp connection terminals, a control circuit coupled to respective control electrodes of the switching devices to generate a lamp current commutating at a commutation frequency, the control circuit being configured for:

during a first interval of a commutation period, for a plurality of alternating first and second time periods rendering the first switching device alternately conducting during each first time period and non-conducting during each second time period at a high frequency being higher than the commutation frequency, during a second interval of the commutation period, for a plurality of alternating third and fourth time periods rendering the second switching device alternately conducting during each third time period and non-conducting during each fourth time period at a high frequency being higher than the commutation frequency, and extending one of the second time periods at the end of the first interval of the commutation period to have a longer duration than the other second time periods, and extending one of the fourth time periods at the end of the second interval of the commutation period to have a longer duration than the other fourth time periods.

4. The lamp driving circuit according to claim 1, further comprising a current sensing circuit configured for:

sensing an inverter inductance current flowing through the inverter inductance, generating an output signal signaling to the control circuit when the inverter inductance current crosses zero, the control circuit being configured for:

in response to receipt of the output signal in the first interval of the commutation period and before the end of the first interval of the commutation period, rendering the first switching device conductive, in response to receipt of the output signal in the second interval of the commutation period and before the end of the second interval of the commutation period, rendering the second switching device conductive, in response to receipt of the output signal at an end of the first interval of the commutation period, not rendering the first switching device conductive, and in response to receipt of the output signal at an end of the second interval of the commutation period, not rendering the second switching device conductive.

5. The lamp driving circuit according to claim 1, wherein the switching devices comprise MOSFET transistors operating in a dual MOSFET mode.

6. A method of operating a gas discharge lamp, the method comprising:

providing a series arrangement of a first switching device and a second switching device, providing an inverter resonant circuit shunting one of the switching devices and comprising an inverter inductance, an inverter capacitance, and lamp connection terminals, controlling a switching of the switching devices to generate a lamp current commutating at a commutation frequency by:

during a first interval of a commutation period, for a plurality of alternating first and second time periods rendering the first switching device alternately conducting during each first time period and non-conducting during each second time period at a high frequency being higher than the commutation frequency, during a second interval of the commutation period, for a plurality of alternating third and fourth time periods rendering the second switching device alternately conducting during each third time period and non-conducting during each fourth time period at a high frequency being higher than the commutation frequency, and extending one of the first time periods at the start of the first interval of the commutation period to have a longer duration than the other first time periods, and extendings one of the third time periods at the start of the second interval of the commutation period to have a longer duration than the other third time periods.

7. The method according to claim 6, further comprising:

sensing an inverter inductance current flowing through the inverter inductance, generating an output signal signaling to the control circuit when the inverter inductance current crosses zero, rendering the first switching device conductive in response to receipt of the output signal in the first interval of the commutation period and before the end of the first interval of the commutation period, rendering the second switching device conductive in response to receipt of the output signal in the second interval of the commutation period and before the end of the second interval of the commutation period, not rendering the second switching device conductive in response to receipt of the output signal at a start of the first interval of the commutation period, and not rendering the first switching device conductive in response to receipt of the output signal at a start of the second interval of the commutation period.

8. A method of operating a gas discharge lamp, the method comprising:

providing a series arrangement of a first switching device and a second switching device, providing an inverter resonant circuit shunting one of the switching devices and comprising an inverter inductance, an inverter capacitance, and lamp connection terminals, controlling a switching of the switching devices to generate a lamp current commutating at a commutation frequency by:

during a first interval of a commutation period, for a plurality of alternating first and second time periods rendering the first switching device alternately conducting during each first time period and non-conducting during each second time period at a high frequency being higher than the commutation frequency, during a second interval of the commutation period, for a plurality of alternating third and fourth time periods rendering the second switching device alternately conducting during each third time period and non-conducting during each fourth time period at a high frequency being higher than the commutation frequency, and extending one of the second time periods at the end of the first interval of the commutation period to have a longer duration than the other second time periods, and extending one of the fourth time periods at the end of the second interval of the commutation period to have a longer duration than the other fourth time periods.

9. The method according to claim 8, further comprising:

sensing an inverter inductance current flowing through the inverter inductance, generating an output signal signaling to the control circuit when the inverter inductance current crosses zero, rendering the first switching device conductive in response to receipt of the output signal in the first interval of the commutation period and before the end of the first interval of the commutation period, rendering the second switching device conductive in response to receipt of the output signal in the second interval of the commutation period and before the end of the second interval of the commutation period, not rendering the first switching device conductive in response to receipt of the output signal at an end of the first interval of the commutation period, and not rendering the second switching device conductive in response to receipt of the output signal at an end of the second interval of the commutation period.

10. The lamp driving circuit according to claim 2, wherein the switching devices comprise MOSFET transistors operating in a dual MOSFET mode.

11. The lamp driving circuit according to claim 3, wherein the switching devices comprise MOSFET transistors operating in a dual MOSFET mode.

12. The lamp driving circuit according to claim 4, wherein the switching devices comprise MOSFET transistors operating in a dual MOSFET mode.

* * * * *